United States Patent [19]

Day

[11] 4,157,082

[45] Jun. 5, 1979

[54] SELF-PURGING FUEL SUPPLY SYSTEM FOR INTERNAL COMBUSTION ENGINES

[75] Inventor: Ralph R. Day, Aurora, Ill.

[73] Assignee: Caterpillar Tractor Co., Peoria, Ill.

[21] Appl. No.: 776,059

[22] Filed: Mar. 9, 1977

[51] Int. Cl.[2] ..... F02M 37/00

[52] U.S. Cl. ..... 123/136; 123/DIG. 2; 210/312

[58] Field of Search ..... 123/136, DIG. 2, 139 R; 210/171, 310, 311, 312, 313, DIG. 5

[56] References Cited

U.S. PATENT DOCUMENTS

| | | | |
|---|---|---|---|
| 1,156,592 | 10/1915 | Davis | 210/311 |
| 2,098,391 | 11/1937 | Irvin | 123/DIG. 2 |
| 2,215,697 | 9/1940 | Hansen | 123/DIG. 2 |
| 2,399,994 | 5/1946 | Feagin | 210/310 X |
| 3,019,904 | 2/1962 | Stecher | 210/312 |
| 3,029,594 | 4/1962 | Miller | 60/605 X |
| 3,550,776 | 12/1970 | Hamilton | 210/312 X |
| 3,768,659 | 10/1973 | Miller | 210/313 |

FOREIGN PATENT DOCUMENTS

| | | | |
|---|---|---|---|
| 45-36537 | 12/1970 | Japan | 210/310 |

*Primary Examiner*—Carlton R. Croyle

*Assistant Examiner*—Michael Koczo, Jr.

*Attorney, Agent, or Firm*—Phillips, Moore, Weissenberger, Lempio & Majestic

[57] ABSTRACT

Water initially contained in fuel tends to separate out and accumulate at certain relatively low points in an engine fuel system. Automatic purging means are provided to remove such water continuously or intermittently without relying on periodic corrective actions by an operator. Purging conduit means are provided to connect the low point of one or more fuel chambers in the fuel system with lower-pressure regions so that accumulated water and a very small amount of the total fuel flow is withdrawn. One purging conduit may communicate the base of the fuel filter housing with a low-pressure point in the engine air intake such as the inlet of a turbocharger. Another purging conduit may connect a low point of the high-pressure region of the fuel pumping chamber with the fuel tank. Where insufficient flow is generated by the pressure differential at opposite ends of a purging conduit, a pumping device may be added and is preferably operated by some component, such as accelerator pedal linkage, that is already present on the engine and which is at least intermittently actuated in the normal course of engine operation.

11 Claims, 3 Drawing Figures

SELF-PURGING FUEL SUPPLY SYSTEM FOR INTERNAL COMBUSTION ENGINES

BACKGROUND OF THE INVENTION

This invention relates to internal combustion engine fuel supply systems and more particularly to apparatus for alleviating harmful effects of water which may initially be present in engine fuel.

Liquid fuels, such as diesel oils, kerosene, gasoline or the like, often become contaminated with small amounts of water. Owing to differences in specific gravities, such water tends to settle to the bottom of various chambers in an engine fuel system, such as the fuel tank itself, water separators, filter chambers and the pumping chambers of fuel pumps or transfer pumps.

A small proportion of water uniformly intermixed with the fuel entering an engine combustion chamber does not usually detract from basic engine efficiency from the thermodynamic standpoint but such water can create very serious problems in other respects, particularly in the fuel supply components of the engine. One major problem is the rusting effect of water on certain metallic parts of fuel pumps, transfer pumps, fuel injectors and the like. This problem is not necessarily confined to the rusted part itself. Rust particles and in some cases fragments of parts that have failed because of rusting can be carried downstream by the fuel flow and damage or cause failure of still other parts.

To forestall the problem discussed above, it has heretofore been the practice to provide draincocks or bowls, which can be removed and emptied, at certain low points in the fuel system so that accumulated water can be eliminated from time to time. This is not always a fully effective solution to the water problem, primarily because it is dependent on the operator taking specific actions at periodic intervals. Through oversight, carelessness, lack of proper training or other reasons, operators may fail to purge the system of accumulated water at the necessary intervals. Engine failure, sometimes accompanied by serious damage to components, can then occur.

SUMMARY OF THE INVENTION

The present invention is directed to overcoming one or more of the problems as set forth above.

According to the present invention, the purging of water from the fuel system of an engine is provided for without requiring operator intervention for this purpose. Broadly, the invention provides one or more water-purging conduits which communicate the base of chambers in the fuel system, where water tends to accumulate, with other points of the system which are at lower pressure and at which water can be disposed of without harmful effects. The purging conduit is proportioned to have a very small flow capacity in relationship to the total fuel flow through the system so that the amount of fuel which may be withdrawn along with accumulated water is not significant. A purging conduit may, for example, connect the base of the fuel filter housing with a suction generating portion of the engine air intake system. Another purging conduit may connect the high-pressure base region of the fuel transfer pump with the fuel tank. In instances where the pressure differential at the two ends of the purging conduit is insufficient to produce the desired purging flow, a pumping device may be provided and is preferbly operated by some existing component of the engine that is actuated at least intermittently in the normal course of engine operation.

DESCRIPTION OF PREFERRED EMBODIMENTS

Figure 1:
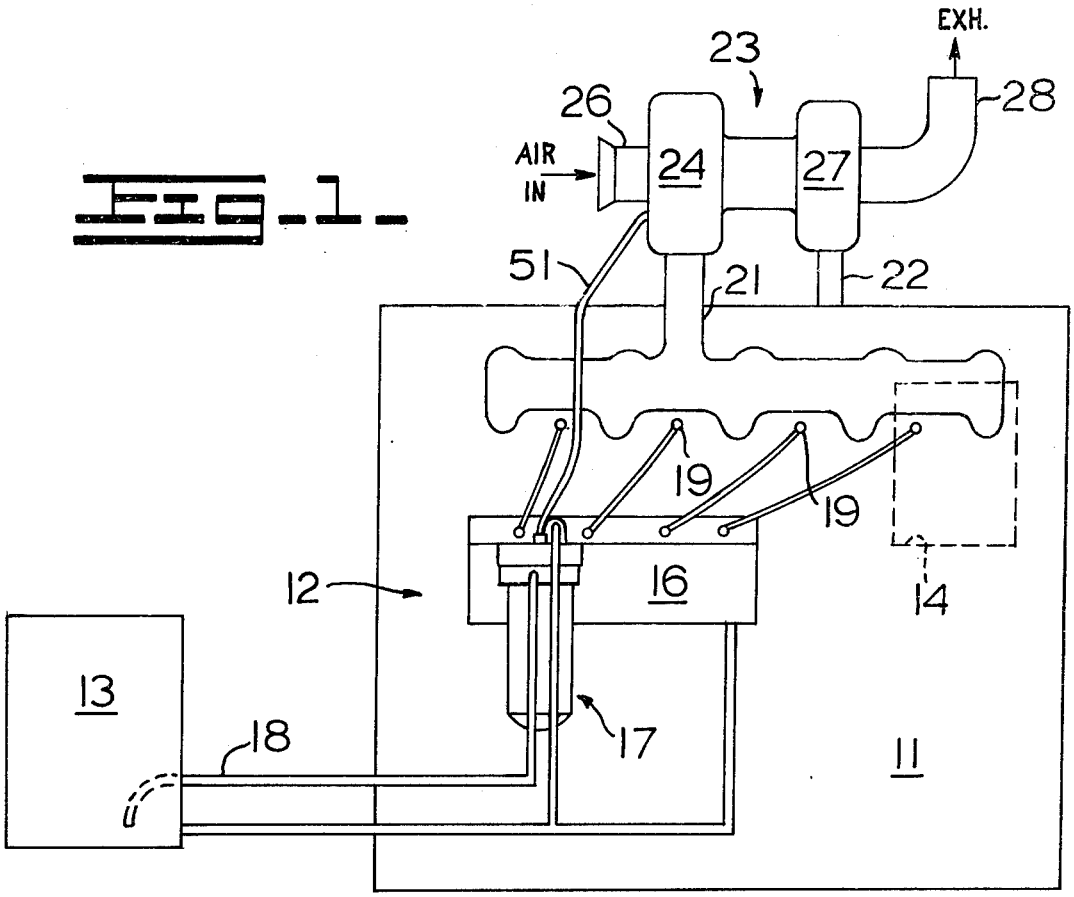
FIG. 1 is a side elevation view of a diesel engine showing fuel system components thereof.

Referring initially to FIG. 1 of the drawing, the engine 11 with which the fuel system 12 of the present invention is employed may be of any of various known internal constructions and is therefore depicted only diagrammatically in the drawing. The engine 11 of this particular example is of the diesel form which operates on diesel oil contained in a fuel tank 13.

To supply fuel to the combustion chambers 14 of the engine a transfer pump 16 draws fuel from tank 13 through a fuel filtering assembly 17 and a fuel supply line 18 that connects the filtering assembly with the tank. Transfer pump 16, which may be of conventional construction except for water-purging arrangements to be hereinafter described, transmits pressurized fuel to a series of fuel injectors 19 which may also be of any suitable known construction. Each fuel injector 19 periodically admits a charge of fuel to an associated one of the engine cylinders or combustion chambers 14. Means for admitting air into the combustion chambers includes an intake manifold 21 and an exhaust manifold 22 receives the combustion products, the manifolds also being of known construction. The engine 11 of this example of the invention is equipped with a turbocharger 23 of the form having a compressor 24 which draws air into an intake 26 and supplies the air under pressure to intake manifold 21 and which also has a turbine 27 which draws combustion products from exhaust manifold 22 and expels such gases through an exhaust conduit 28.

Figure 2:
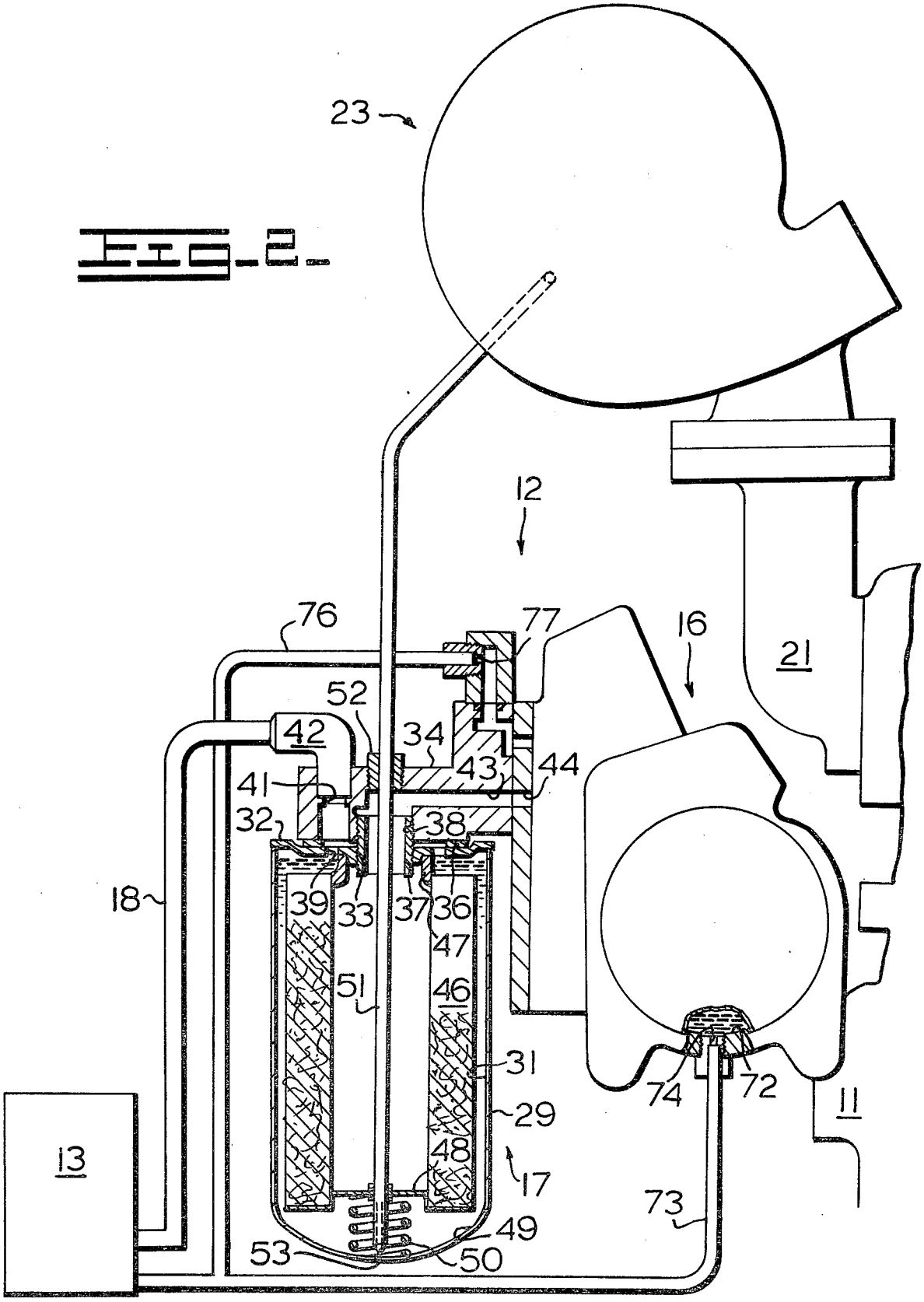
FIG. 2 is an end view of portions of the fuel system of FIG. 1 with certain components being shown in section in order to illustrate internal detail.

Referring now to FIG. 2, fuel filtering assembly 17 may have an upright cylindrical housing 29 forming a fuel chamber 31. The upper end closure of the housing 29 is an annular plate 32 having an internally threaded central passage 33. Upper end closure plate 32 is situated beneath a mounting member 34 which is secured to the transfer pump 16, an annular seal 36 being disposed between plate 32 and the underside of the mounting member 34. Housing 29 is fastened to mounting member 34 by means of an externally threaded sleeve 37 which engages in the threaded central passage 33 of closure plate 32 and also in an internally threaded passage 38 of the mounting member.

Closure plate 32 has a series of apertures 39 which communicate fuel chamber 31 with an inlet passage 41 in mounting member 34. Fuel supply line 18 from fuel tank 13 is communicated with passage 41 through a fitting 42 on the mounting member.

To transmit fuel on to transfer pump 16, another passage 43 in mounting member 34 connects passage 38 with the fuel inlet 44 of the transfer pump.

Filtering of the fuel is accomplished with a tubular porous filter element 46 disposed coaxially in housing 29. An annular end member 47 of the filter element seats against the inner portion of housing end closure 32 and the bottom end of the filter element is closed and supported by a disc 48, a compression spring 50 being disposed in housing 29 to exert an upward force against the disc. As a consequence, fuel must flow through the porous wall of the element to pass from inlet fitting 42 to transfer pump inlet 44.

In operation, transfer pump 16 creates a suction at fuel inlet 44 which draws fuel from tank 13 through supply line 18 and into filter housing 29 where the fuel must then pass through the porous filter element 46 in order to reach pump inlet 44. Water contained in the fuel drawn from tank 13 tends to settle to the bottom region 49 of the filter assembly fuel chamber 31. If not removed, the water level in region 49 eventually rises above the lower end of filter element 46 at which point the water-trapping effect of the fuel filtering assembly 17 is no longer effective to prevent water from being transmitted on towards the transfer pump 16 and fuel injectors 19. Appreciable amounts of water may in fact be transmitted on prior to the time when the fuel-water interface rises to filter element 46. The vibration commonly experienced by engine components tends to create an emulsion of fuel and water above the interface which as a practical matter carries water droplets above the nominal water level.

Carry-over of water into the transfer pump 16 and on into other components such as the fuel injectors 19 can have very damaging effects. In many cases, parts of these components are formed of metal which may rust. Aside from the direct effect of rusting on such parts, released rust particles or even fragments of such parts which have broken as a consequence of rusting may interfere with the operation of still other parts. Screens may be clogged, for example, and may then burst from the high fuel pressure generated by the transfer pump. Tests of certain engines deliberately using water-contaminated fuel and with all water separation provisions deliberately removed have demonstrated that serious and costly component failures may occur in periods of as little as four to eighty hours of engine operation.

Preventive measures heretofore employed in the art have included requiring the operator or maintenance personnel to periodically remove water from certain points in the fuel system where it accumulates. Filter bowls may be removed and emptied, for example, and drain cocks at appropriate points in the fuel system may be temporarily opened. On certain earth-working vehicles, for example, it may be prescribed procedure at the start of each work shift. A basic problem in this technique is that it is dependent on proper actions being taken by an operator or the like. For any of various reasons, such as lack of training, forgetfulness, lack of appreciation of the importance of the procedure or other causes, the necessary steps may not be carried out on occasion.

The present invention provides for a continual or at least intermittent removal of accumulated water that occurs automatically without any direct intervention by the operator. One or more low points of fuel chambers in the system are communicated with suitable water disposal points which are at least intermittently at a lower pressure so that a very small flow of liquid is at least intermittently drawn away from the water accumulation points during operation of the engine.

In the example of the invention depicted in FIG. 2, a first tubular purging conduit 51 extends through a fitting 52 at the top of mounting member 34 and then downward along the central axis of housing 29. An intake orifice 53 at the lower end of purging conduit 51 is situated substantially at the low point of the filter assembly fuel chamber 31.

The upper end of purging conduit 51 is communicated with a point in the air intake system of the engine that exhibits a negative pressure during engine operation so that a small flow of fluid is drawn from the bottom region 49 of the fuel filter assembly into the engine air intake. In the present example and as best seen in FIG. 1, the upper end of purging conduit 51 is communicated with the intake side of tubocharger compressor 24 for this purpose.

Thus at such times as the pressure at the compressor intake is less than that in filter fuel chamber 31, a small flow of fluid from the base of the fuel chamber is continually withdrawn and discharged into the flow of air entering the engine. Referring again to FIG. 2, the amount of this flow is determined by the size of the intake orifice 53 at the lower end of purging conduit 51 which orifice is selected to limit the flow to a small value relative to the total fluid flow through the fuel system but which is at least equal to the rate of water flow to the base of housing 29. As the rate of water accumulation in housing 29 may be somewhat variable, orifice 53 is preferably sized to draw away a small amount of fuel, in addition to the accumulated water, to assure that no build-up of water will occur under varying conditions. In a typical case, orifice 53 may be sized to draw away about one quart or liter of fluid during an eight-hour period of operation. The injection of this very small flow of water and fuel into the air entering the combustion chambers has no appreciable effect on engine efficiency.

In engines which are not equipped with a turbocharger 23, the outlet end of the purging conduit 51 may connect directly to the engine air intake manifold 21 or to the venturi throat of a carburetor when one is present as negative pressures are also found at such points.

Figure 3:
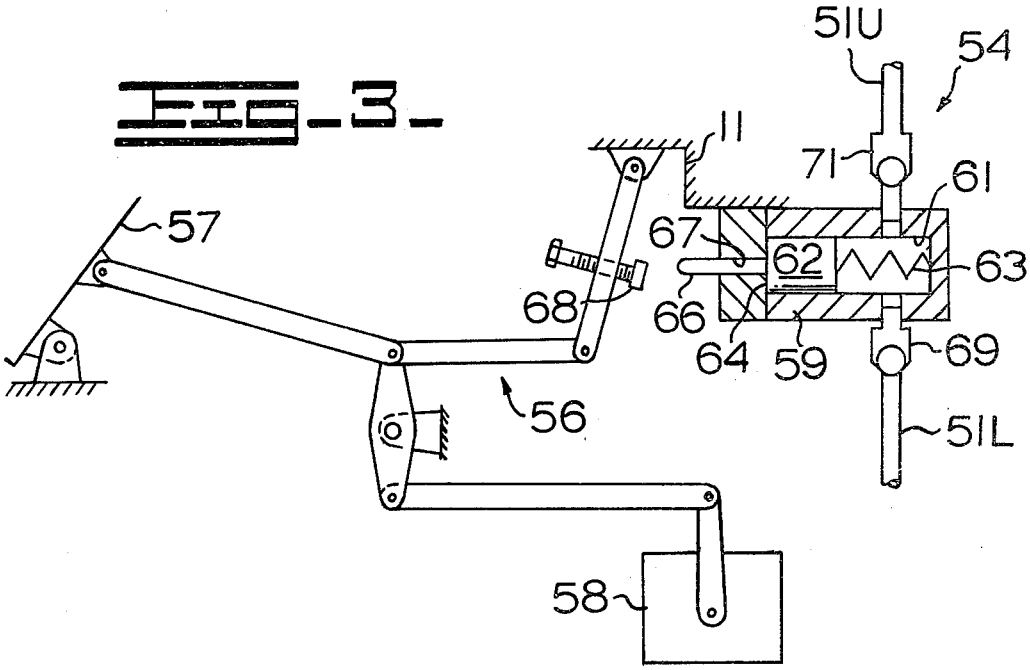
FIG. 3 is a diagrammatic view of a modification of the fuel system of FIGS. 1 and 2.

In instances where the suction generated by the means described above is insufficient to maintain the desired flow through purging conduit 51, such as in an engine which operates for long periods at the low idle governor or throttle setting, pumping means 54 may be provided for this purpose as depicted in FIG. 3. Although a continuously operated pump might be employed, the pumping means 54 of this example is arranged to be operated intermittently in response to operation of another component which occurs from time to time in the course of engine operation. Where the engine powers a vehicle, this other component may be the linkage 56 which interconnects the operator's accelerator pedal 57 with the engine governor 58 or throttle.

In particular, pumping means 54 may include a body 59 having an internal bore 61 in which a piston 62 is disposed for reciprocation. A compression spring 63 urges piston 62 towards one end 64 of the bore. A rod 66 extends axially from piston 62 through a passage 67 in end 64 of the body. The pumping means 54 is secured to the engine 11 at a position where rod 66 is depressed, to reciprocate piston 62, by an element 68 carried on movable linkage 56 each time that accelerator pedal 57 is depressed and retracted.

The previously described purging conduit 51, which may otherwise be arranged as depicted in the preceding figures, is in this instance divided into a lower segment 51L which connects with bore 61 through a first check valve 69 and an upper segment 51U which connects to bore 61 through another check valve 71. Check valve 69 is oriented to admit fluid from conduit segment 51L into bore 61 while blocking flow in the reverse direction. Check valve 71 is oriented to admit fluid from bore 61 into conduit segment 51U while blocking any reversed flow. Thus a pumping action is realized in purging conduit 51 each time that the accelerator pedal 57 is operated.

The removal of water may be accomplished at points in the fuel system apart from the fuel filter assembly and the removed water may be released at points other than the engine air intake system, either alternatively to the purging means described above or for supplemental protection. Referring again to FIG. 2, supplemental water-purging means is provided at the transfer pump 16. If the fuel filter chamber purging means described above should malfunction or if, owing to the presence of excessively wet fuel, the purging capacity at the filter assembly should be exceeded, then water may be transmitted on to the inlet 44 of transfer pump 16. Such water will then tend to accumulate at the lower portion 72 of the pumping chamber of the transfer pump. A second purging conduit 73 has one end connected to the base of the pumping chamber 72 through a flow-fixing orifice 74 to withdraw a small amount of fluid including any water which may accumulate. If the lower region 72 of the pumping chamber is part of the inlet or low-pressure side of the pump, the discharge end of second purging conduit 73 may be coupled to a suction-generating part of the engine air intake system as previously described with respect to the first purging conduit 51. Where, as in this example, the bottom region 72 of the pump fuel chamber is part of the high-pressure output side of the pump, the discharge end of second purging conduit 73 may be communicated with a region at atmospheric pressure or even one at a higher pressure and in this case is communicated with the fuel tank 13. Thus, the second purging conduit 73 provides for the return flow of a small amount of fuel back to tank 13 which return flow carries away any water which may have settled to the bottom portion 72 of the pump fuel chamber.

In this example, a second purging conduit 73 is joined by still a third purging conduit 76 which is communicated with the upper region of transfer pump 16 through another flow-controlling orifice 77. This additional return flow of a small amount of fuel back to tank 13 carries away any air which may have been entrained in the fuel flow to the engine and which is subsequently accumulated at the top region of the transfer pump.

While the invention has been described with respect to certain specific embodiments, many modifications and variations are possible and it is not intended to limit the invention except as defined in the following claims.

The embodiments of the invention in which an exclusive property or privilege is claimed are defined as follows:

1. A fuel system for an engine which has a fuel combustion chamber, means forming an air passage for admitting air to said combustion chamber, a fuel tank and a pumping device for transferring fuel from said tank to said combustion chamber through a fuel flow path, said fuel system further comprising: a housing defining a liquid fuel chamber which forms a portion of said fuel flow path and which contains a volume of liquid fuel during operation of said engine and in which liquid water from said fuel tends to collect, said fuel chamber having an inlet for receiving liquid fuel and an outlet for transmitting liquid fuel on towards said combustion chamber, said outlet being situated above the bottom region of said fuel chamber, and a water purging conduit means connected to said housing and communicating said bottom region of said fuel chamber with a discharge point in said system which is away from said fuel chamber and which is at least intermittently at a lower pressure than said bottom region of said fuel chamber during periods when said engine is operating thereby creating a pressure difference between the ends of said purging conduit means which forces an outflow of liquid from said bottom region of said fuel chamber through said purging conduit means during said periods when said engine is operating and said discharge point is at said lower pressure.

2. A fuel system as defined in claim 1 wherein said purging conduit means is proportioned to withdraw a flow of liquid from said bottom region of said fuel chamber which is very small in relation to the total flow of liquid fuel through said fuel flow path.

3. A fuel system for an engine which has a fuel combustion chamber, means forming an air passage for admitting air to said combustion chamber, a fuel tank and a pumping device for transferring fuel from said tank to said combustion chamber through a fuel flow path, said fuel system further comprising: a housing defining a liquid fuel chamber which forms a portion of said fuel flow path and which contains a volume of liquid fuel during operation of said engine and in which liquid water from said fuel tends to collect, said fuel chamber having an inlet for receiving liquid fuel and an outlet for transmitting liquid fuel on towards said combustion chamber, said outlet being situated above the bottom region of said fuel chamber, and a water purging conduit means connected to said housing and communicating said bottom region of said fuel chamber with a liquid discharge point in said means forming an air passage for admitting air to said combustion chamber which discharge point is at a lower pressure than said bottom region of said fuel chamber during operation of said engine.

4. A fuel system as defined in claim 3 wherein said means forming an air passage for admitting air to said combustion chamber is a turbocharger.

5. A fuel system for an engine which has a fuel combustion chamber, means forming an air passage for admitting air to said combustion chamber, a fuel tank and a pumping device for transferring fuel from said tank to said combustion chamber through a fuel flow path, said fuel system further comprising: a housing defining a fuel chamber which forms a portion of said fuel flow path, said fuel chamber having an inlet for receiving fuel and an outlet for transmitting fuel on towards said combustion chamber, said outlet being situated above the bottom region of said fuel chamber, and a water purging conduit means connected to said housing and communicating said bottom region of said fuel chamber with a discharge point in said system which is away from said fuel chamber and which is at least intermittently at a lower pressure than said bottom region of said fuel chamber during periods when said engine is operating thereby creating a pressure difference between the ends of said purging conduit means which forces an outflow of fluid from said bottom region of said fuel chamber through said purging conduit means during said periods when said engine is operating and said discharge point is at said lower pressure, wherein said housing is a fuel filter housing and further comprising a porous filter element disposed in said chamber in the path of fluid traveling from said inlet to said outlet, said purging conduit means being communicated with the part of said flow path between said inlet and said filter element.

6. A fuel system for an engine which has a fuel combustion chamber, means forming an air passage for admitting air to said combustion chamber, a fuel tank and a pumping device for transferring fuel from said tank to said combustion chamber through a fuel flow path, said fuel system further comprising: a housing defining a fuel chamber which forms a portion of said fuel flow path, said fuel chamber having an inlet for receiving fuel and an outlet for transmitting fuel on towards said combustion chamber, said outlet being situated above the bottom region of said fuel chamber, and a water purging conduit means connected to said housing and communicating said bottom region of said fuel chamber with a point in said system which is away from said fuel chamber, and a pumping device having an inlet port and an outlet port, said purging conduit means being connected between said bottom region of said fuel chamber and said inlet port of said pumping device.

7. A fuel system as defined in claim 6 wherein said engine has a control linkage which is intermittently manipulated by the operator of said engine in the course of operation thereof, further comprising means coupling said pumping device to said linkage for operating said pumping device in response to operation of said control linkage.

8. A fuel system as defined in claim 7 wherein said engine has a speed-controlling device and an accelerator pedal connected thereto by said control linkage.

9. A fuel system for an engine which has a fuel combustion chamber, means forming an air passage for admitting air to said combustion chamber, a fuel tank and a pumping device for transferring fuel from said tank to said combustion chamber through a fuel flow path, said fuel system further comprising: a housing defining a fuel chamber which forms a portion of said fuel flow path, said fuel chamber having an inlet for receiving fuel and a outlet for transmitting fuel on towards said combustion chamber, said outlet being situated above the bottom region of said fuel chamber, wherein said housing is the housing of a fuel transfer pump and said fuel chamber is the pumping chamber thereof and a water purging conduit means connected to said housing and communicating said bottom region of said fuel chamber with a discharge point in said system which is away from said fuel chamber and which is at least intermittently at a lower pressure than said bottom region of said fuel chamber during periods when said engine is operating thereby creating a pressure difference between the ends of said purging conduit means which forces an outflow of fluid from said bottom region of said fuel chamber through said purging conduit means during said periods when said engine is operating and said discharge point is at said lower pressure.

10. A fuel system as defined in claim 9 wherein said fuel transfer pump has means in said pumping chamber which produces a pressure differential between a relatively low-pressure region with which said inlet communicates and a relatively high-pressure region with which said outlet communicates, and wherein said bottom region of said chamber with which said purging conduit means communicates is a part of said relatively high-pressure region.

11. A fuel system as defined in claim 10 wherein said purging conduit means communicates said bottom region of said fuel chamber with said fuel tank.

* * * * *